United States Patent [19]

Jerles

[11] 4,058,702

[45] Nov. 15, 1977

[54] FLUID HEATING APPARATUS

[75] Inventor: James B. Jerles, Tierra Verde, Fla.

[73] Assignee: Electro-Thermal Corporation, Pensacola, Fla.

[21] Appl. No.: 679,881

[22] Filed: Apr. 26, 1976

[51] Int. Cl.[2] ..... H05B 1/00

[52] U.S. Cl. ..... 219/321; 219/327; 219/328; 219/330; 219/486

[58] Field of Search ..... 219/321, 330, 327, 328, 219/331, 486, 494

[56] References Cited

U.S. PATENT DOCUMENTS

| | | | |
|---|---|---|---|
| 1,284,876 | 11/1918 | Clark et al. | 219/321 X |
| 2,779,855 | 1/1957 | Sawyer | 219/321 X |

*Primary Examiner*—C. L. Albritton

*Attorney, Agent, or Firm*—Gust, Irish, Jeffers & Rickert

[57] ABSTRACT

A fluid tank, with an inlet and an outlet, is provided with first heating means for heating the fluid in the tank to a first temperature and a second heating means for heating the fluid to a second temperature which is lower than the first temperature. A thermostatic switch is disposed to be responsive to the temperature of the fluid in the tank outlet to enable the first heating means only when the temperature in the outlet is above a predetermined level. The fluid in the tank is maintained at a low temperature during periods of non-use, and at an increased temperature only during periods of use, thus economizing on heating energy.

9 Claims, 4 Drawing Figures

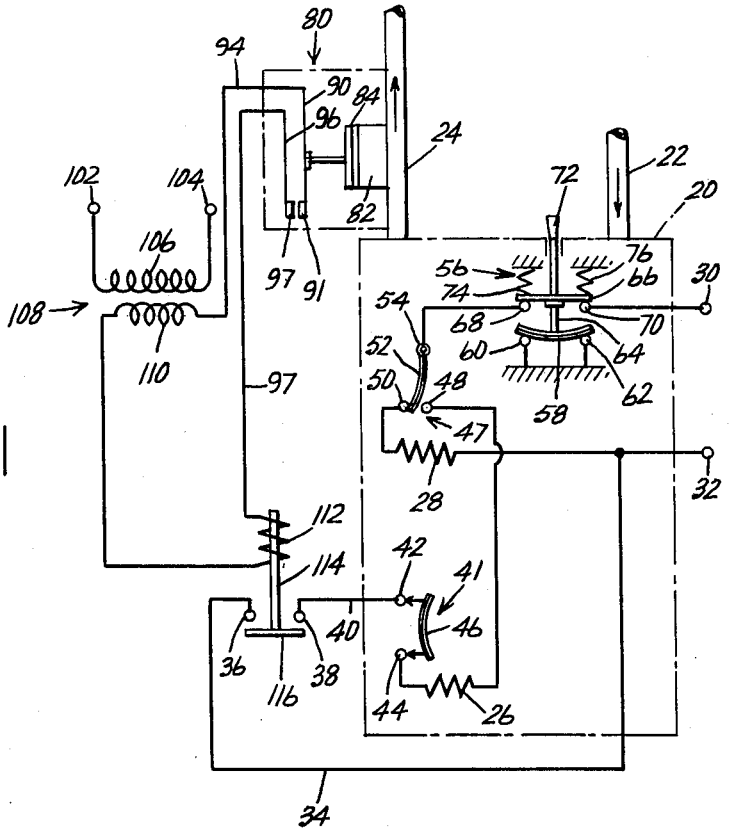
FIG.1
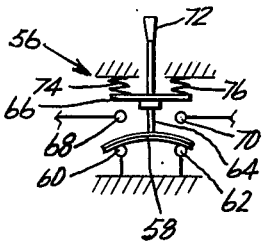
FIG.1A
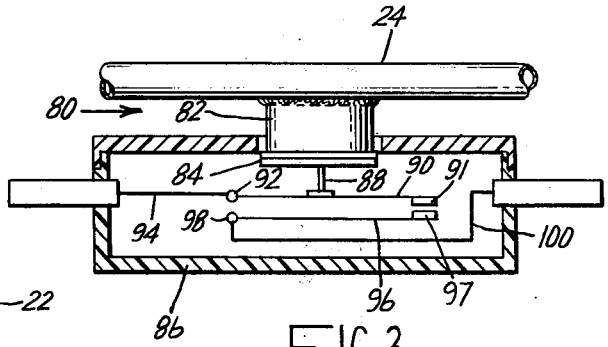
FIG.3
FIG.2
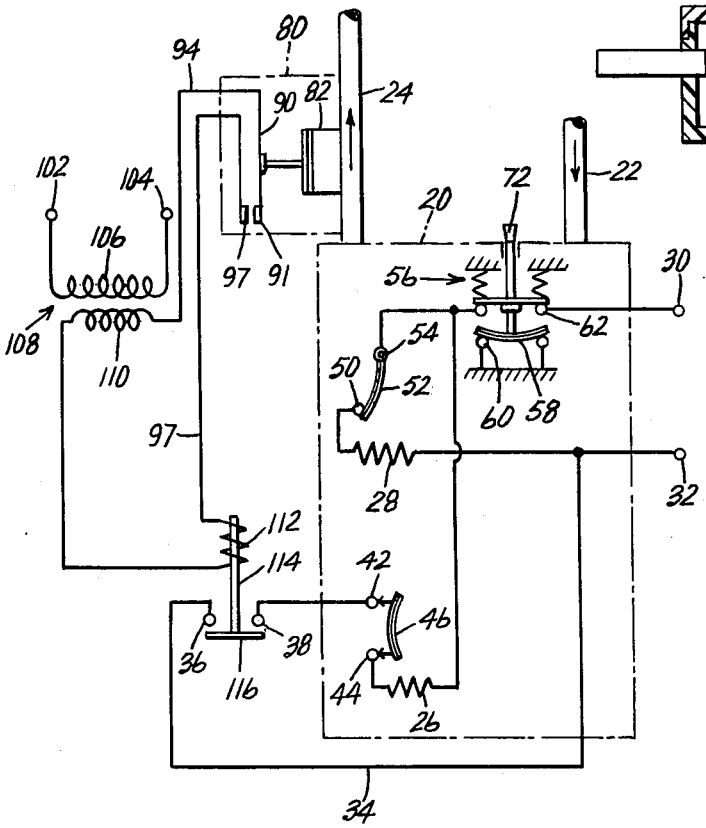

FLUID HEATING APPARATUS

BACKGROUND OF THE INVENTION

1. Field of the Invention

This invention is in the field of fluid heating apparatus such as a water heater for household and other uses.

2. Description of the Prior Art

Prior art systems for heating fluid have various combinations of thermostatic switches and heating elements to provide adequate supply on demand together with a minimum of energy consumption. In hot water heaters, for example, multiple heating elements and thermostatic switch devices have been used. However, due to the condtradictory objectives of providing hot water on demand and economizing on heating energy during periods of non-use, or low-use, such efforts have been compromises which have not been entirely satisfactory.

SUMMARY OF THE INVENTION

A water tank has a cold water inelt pipe and a hot water outlet pipe and is provided with a first heating element for heating the water in the tank. The first element has, in the energizing circuit thereof, a bimetallic thermostatic switch responsive to the temperature of the water in the tank. The switch closes when the water temperature is below a given temperature, such as 145° F., and opens when the water temperature is above such given temperature. A second heating element for heating the water in the tank is provided and is responsive to the operation of a second bimetallic switch which closes when the water temperature is below a given temperature, such as 115° F. and opens when the water temperature is above such given temperature. A third bimetallic thermostatic switch senses the temperature in the outlet pipe, opening when the water is below a given temperature, such as 90° F., and closing when the water temperature is above such given temperature. A solenoid switch in the circuit of the first heating element is responsive to the third bimetallic switch, closing when the third switch is closed and opening when the third switch is opened. The solenoid switch when closed enables the first heating element for energization when the first thermostatic switch closes.

During periods of non-use of heated water from the tank, the temperature of the water in the outlet pipe will drop since the water in that pipe will lose its heat to the ambient air. This opens the third bimetallic switch and the solenoid switch thus preventing energization of the first heating element even though the first bimetallic switch is closed. Therefore, the only energy for heating the water in the tank is the second heating element which heats the water to a lower temperature during such periods of non-use. Thus a substantial savings of heating energy is realized since in the normal household, hot water demands are made on a cyclical basis, periods of non-use or low-use predominating. However, during periods of hot water usage, the temperature in the hot water outlet will increase to a level above 90° F. due to the heated water from the tank passing therethrough. At this point, the third bimetallic switch will close energizing and closing the solenoid switch, enabling the first heating element which is a relatively high energy, fast heating element to quickly raise the water temperature in the tank during such periods of use. Thus, during periods of hot water use the tank temerature is high and during periods of non-use, the tank water temperature is low, resulting in substantial heating energy savings.

If desired, and where required by local utility regulations, the second thermostatic switch may be an interlock switch so that both the first heating element and the second heating element cannot be energized at the same time. This may be accomplished by making the second thermostatic element a single pole, double throw switch which closes only one of the heating element energizing circuits at a time. Also, a thermostatic safety switch responsive to tank water temperature will open the power circuit for energizing both heating elements when the tank water temperature exceeds a given level. The safety switch must be manually reset, which can be done when the water temperature falls below a maximum level. This invention may also be utilized in low volume, quick heating hot water systems which are known to the art.

It is therefore an object of this invention to provide an energy saving fluid heating apparatus.

It is a further object of this invention to provide an apparatus of the foregoing object for sensing the fluid temperature in the fluid outlet to enable a fluid heating element for heating tank fluids.

It is a further object to provide in the apparatus of the foregoing object multiple heating elements for heating the fluid to first and second temperatures, the higher temperature element being enabled only during periods of fluid use and the lower temperature element being enabled during periods of fluid non-use.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a schematic circuit diagram showing a first preferred embodiment with the water tank shown in phantom;

FIG. 1*a* is a schematic diagram of the safety switch in an open condition;

FIG. 2 is a schematic circuit diagram showing a second embodiment with the water tank shown in phantom; and FIG. 3 is a partially schematic sectioned view of a thermostatic switch used in the embodiments of FIGS. 1 and 2.

DESCRIPTION OF THE PREFERRED EMBODIMENT

Referring to the drawings, a first preferred embodiment is shown schematically in FIG. 1, FIG. 1*a* and FIG. 3. A hot water tank 20 is shon in phantom in FIG. 1 and has water inlet pipe 22 and water outlet pipe 24. The water within tank 20 in the embodiments in this invention is heated by electrical heating elements 26 and 28, but it is to be understood that this invention applies as well to other ways and means of water heating, such as by gas. Electrical power for providing heating energy to elements 26 and 28 is connected to terminals 30 and 32 and may be conventionally available household power such as 220 volts, 60 Hz. Terminal 32 is connected by way of line 34 to relay switch terminal 36. Switch terminal 38 is connected by line 40 to a first bimetallic switch 41 having terminals 42 and 44 and bimetallic element 46 which connects electrically terminals 42 and 44 when the water temperature in tank 20 is below a given temperature, such as 145° F. Bimetallic switch 41 may be any suitable commercially available bimetallic switch. Terminal 44 is connected through heating element 26 to a second conventional bimetallic thermostatic switch 47 and has terminals 48 and 50. A bimetallic switch element 52 is mounted at one end to terminal 54 which is connected through safety switch assembly 56 to terminal 30. Bimetallic element 52 will switch from terminal 50 to terminal 48 whenever the tank water temperature exceeds a given level, such as 115° F, which is lower than that level at which switch 41 opens. Thus element 52 and terminals 48 and 50 form a single pole, double-throw bimetallic thermostatic switch. When element 52 is contacting terminal 50, a circuit is established between terminals 30 and 32 through heating element 28 and switch 56. When element 52 is in its alternate position, in contact with terminal 48, a circuit is established between terminals 30 and 32 through heating element 26, switch 56, element 46, and relay terminals 36 and 38, when they are closed by circuitry later described.

Switch 56 is a conventional safety switch. Many utility regulations require such a switch to open the circuit to the heating elements when the tank water temperature exceeds a given temperature. The circuit will remain open until it is manually reset. The bimetallic element 58 is mechanically mounted at each of its ends to fixed mounting points 60 and 62. The center of element 58 is mechanically coupled to an insulative pin 64 which is in fixed relation to electrically conductive contact 66. Contact 66 in its lower position closes terminals 68 and 70. Insulative button 72 is an extension of pin 64 and extends to the exterior of tank 20 so that it is manually accessible for reasons later described. Plate 66 is spring urged by springs 74 and 76. In normal operation of the tank, switch 56 will be in its "closed" position wherein contact 66 closes terminals 68 and 70. Prior to the tank water temperature reaching a dangerous level, element 58 will change position, to that shown in FIG. 1*a*, forcing plate 66 upwardly against the force of springs 74 and 76. This opens the circuit to both heating elements 26 and 28 which circuits will remain open until button 72 is manually depressed, restoring element 58 to its position, shown in FIG. 1. In other words, even if the tank water temperature should fall below a predetermined maximum, the switch 56 will still remain open until button 72 is manually depressed.

A third thermostatic bimetallic switch 80 is operable by the temperature of the water in pipe 24.

Referring to FIG. 3, a cylindrical plug 82 of a high heat conductivity material, such as copper, is thermally attached to pipe 24, which is preferably of a high heat conductivity material such as copper. Physically attached to plug 82 is bimetallic switch element 84 mounted in a housing 86. Pin 88 is attached to and between elements 84 and resilient upper switch blade 90. Blade 90 carries contact 91 at its end, is mounted at 92 and is electrically connected to line 94. Lower resilient switch blade 96 carries contact 97 at its end, is mounted at 98 and electrically connected to line 100. When the water in pipe 24 is below a given temperature, such as 90° F., element 84 will maintain blade 90 in its upper position, so that electrical contacts 91 and 97 are open. However, when the water temperature in pipe 24 exceeds 90° F., as it would during hot water usage due to the heated water from tank 20 passing through pipe 24, element 84 will move blade 90 to a downward position closing contacts 91 and 97. The switch 80 is positioned on pipe 24 far enough removed from tank 20 that during prolonged periods of no hot water being drawn, the pipe 24 as well as the switch 80 will cool down to a temperature below 90° F.

Referring to FIG. 1, terminals 102 and 104 are connected to an available household voltage supply, such as 220 volts, 60 Hz, placing this voltage across primary 106 of transformer 108. Secondary 110 reduces the voltage to approximately 24 volts which is placed across solenoid coil 112 when contacts 91 and 97 are closed. When coil 112 is so energized, armature 114 raises contact plate 116 closing contacts 36 and 28 and enabling heating element 26.

In operation of the embodiment of FIG. 1, and assuming a condition of prolonged non-hot water usage, the temperture of the water in pipe 24 will be low, below 90° F., since its heat will have dissipated to the ambient air. In this condition, bimetallic thermostatic element 84 will be in its upper position, FIG. 3, and contacts 91 and 97 will be open. This opens the circuit of secondary 110 and armature 114 is in its lower position, FIG. 1, and contacts 36 and 38 will be open. Therefore, even though element 46 has closed contacts 42 and 44, since the tank water temperature is considerably below 145° F., heating element 26 will be deenergized. Heating element 28, however, will be energized a sufficient portion of the time to maintain the tank water temperature at approximately 115° F. This is because element 52 will make electrical contact with terminal 50 whenever the water temperature drops below 115° F.

When hot water usage increases, the water temperature in pipe 24 will rise to approximately 115° F., the tank water temperature, and will close contacts 91 and 97, energizing solenoid coil 112 from the voltage developed across secondary 110, whereby conductive plate 116 will close switch terminals 36 and 38 enabling element 26. As mentioned, bimetallic switch 46 already has closed terminals 42 and 44. If switch element 52 is in contact with terminal 48, indicating the water temperature is above 115° F., or when element 52 contacts terminal 48, element 26 will be energized since a current path will be completed between terminals 30 and 32. The tank water will quickly rise to 145° F. due to energization of heating element 26 which is a heavy duty, high energy, fast acting element. This will maintain switch element 52 in contact with terminal 48 and switch element 46 will maintain contacts 42 and 44 closed until the tank water temperature exceeds 145° F. at which time switch element 46 will open the contact between terminals 42 and 44.

If during the increased hot water usage, which would close contacts 91 and 97, element 52 is on contact 50, indicating that element 28 is being energized, it will be necessary to wait until the tank water temperature exceeds 115° F. and element 52 makes contact with contact 48 before element 26 is energized. This generally will be on only a short while. With the circuitry of FIG. 1, element 52 provides an interlock preventing both heating elements 26 and 28 from being energized at the same time, thereby reducing the peak power requirements.

Referring to FIG. 2, similar elements will carry similar reference numerals to those in FIG. 1. In the embodiment shown in FIG. 2 there is no interlock and heating elements 26 and 28 may both be energized momentarily during hot water usage whereas only element 28 is energized during non-hot water usage. Safety switch 56 operates in identically the same manner as switch 56 in FIG. 1. Also, thermostatic bimetallic switch element 46 operates in the manner of element 46 in FIG. 1 as does bimetallic thermostatic assembly 80. All the remaining elements also operate identically with the exception that when switch element 52 breaks connection with contact 50, it does not make contact with a conductor through which element 26 is energized since element 26 is connected directly to switch 56. In operation of the embodiment of FIG. 2, during prolonged periods of non-hot water usage, the temperature of the water in pipe 24 will be below 90° F., so that contacts 91 and 97 will be open. Solenoid 112 will be inactive and plate contact 116 will be in its lower position, so that terminals 36 and 38 will not be electrically connected. This will disable heating element 26, whether or not element 46 has closed contacts 42 and 44. During this period, tank water temperature is kept approximately at 115° F., since below that temperature element 52 will make contact between contacts 50 and 54 energizing heating element 28. However, during periods of hot water usage, the temperature of the water in pipe 24 will rise causing contacts 91 and 97 to close, energizing solenoid coil 112 due to the voltage developed across secondary 110 in transformer 108, raising armature 114 so that plate 116 makes electrical contact between terminals 36 and 38 thus enabling the heating circuit for element 26. Since the tank water temperature at this point is below 145° F., element 46 will be in the switch position to make electrical contact between terminals 42 and 44 energizing element 26. Elements 26 and 28 will both be energized if the water temperature is below 115° F. Element 52 will open when the water tank temperature exceeds 115° F. and only element 26 will provide the heating for tank 20 after that point.

In this embodiment, as in the embodiment of FIG. 1, the tank water temperature is maintained approximately at 115° F. during non-usage. During hot water usage, tank water temperature is increased to 145° F. Therefore, during periods of non-hot water use such as at nighttime and during the day, the tank water temperature will be at 115° F. instead of 145° F., providing a considerable saving in heating energy. As mentioned, this invention may be used equally well as gas fired heaters and also may be used in quick heating, low capacity water tanks.

While there have been described above the principles of this invention in connection with specific apparatus, it is to be clearly understood that this description is made only by way of example and not as a limitation to the scope of the invention.

What is claimed is:

1. Fluid heating apparatus comprising:

a fluid tank having a fluid outlet through which fluid from the tank may flow, said outlet being in heat-dissipating relation to a heat energy absorbing medium;

first heating means for heating the fluid in said tank to a first temperature; and control means for sensing the outlet fluid temperature and for activating said first heating means responsive to fluid temperatures above a predetermined level in said outlet and for deactivating said heating means in response to fluid temperatures in said outlet below said level.

2. Fluid heating apparatus according to claim 1 including second heating means for heating the fluid in said tank to a second temperature lower than said first temperature and at least as high as said predetermined level.

3. Fluid heating apparatus according to claim 2 including interlock means for preventing both said first and second heating means from being energized at the same time.

4. Fluid heating apparatus according to claim 2 wherein said first heating means includes a first thermostatic switch means actuably responsive to temperatures above the first fluid temperature in said tank for deactivating said first heating means;

said second heating means includes a second thermostatic switch means actuably responsive to tempertures above the second fluid temperature in said tank for deactivating the second heating means; and said control means includes a third thermostatic switch means actuably responsive to temperatures below a third temperature of the fluid in said outlet, for deactivating said first heating means, said third temperature being lower than said second temperature.

5. Fluid heating apparatus according to claim 4 wherein said first heating means includes a first heating element circuit and said second heating means includes a second heating element circuit;

said second thermostatic switch being a single pole double throw switch having a first switch position activating said first circuit and deactivating said second circuit and a second switch position activating said second circuit and deactivating said first circuit.

6. Fluid heating apparatus according to claim 4 wherein said control means further comprises a solenoid switch responsive to actuation of said third thermostatic switch for activating said first heating means when the temperature in said outlet is above said third temperature.

7. Apparatus for use with a fluid heating tank having fluid outlet in heat-dissipating relation to a heat absorbing medium and a heating element comprising;

first means for thermally engaging the fluid outlet and sensing the temperature of the fluid in the outlet, and for providing a signal when said temperature is above a predetermined level;

second means responsive to said first means signal for activating the heating element in the tank.

8. Apparatus of claim 7 wherein said first means comprises a thermostatic switch actuably responsive to the temperature of the fluid in the outlet to provide said first means signal.

9. Apparatus of claim 8 wherein said second means comprises a solenoid switch actuably responsive to said first means signal for activating the heating element when the temperature in the outlet is above a predetermined level.

* * * * *

UNITED STATES PATENT AND TRADEMARK OFFICE

CERTIFICATE OF CORRECTION

PATENT NO. : 4,058,702

DATED : November 15, 1977

INVENTOR(S) : James B. Jerles

It is certified that error appears in the above-identified patent and that said Letters Patent are hereby corrected as shown below:

| | |
|---|---|
| Col. 1, line 67, | after "tank" insert --water--. |
| Col. 1, line 68, | "temerature" should be --temperature--. |
| Col. 2, line 15, | after "done" insert --only-- |
| Col. 2, line 55, | "shon" should be --shown--. |
| Col. 5, line 44, | "as" should be --on--. |

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*